US009556697B1

(12) United States Patent
Spinks

(10) Patent No.: US 9,556,697 B1
(45) Date of Patent: Jan. 31, 2017

(54) WELLHEAD SYSTEM AND METHOD FOR INSTALLING A WELLHEAD SYSTEM

(71) Applicant: Mike Spinks, The Woodlands, TX (US)

(72) Inventor: Mike Spinks, The Woodlands, TX (US)

(73) Assignee: Cactus Wellhead, LLC, Houston, TX (US)

( * ) Notice: Subject to any disclaimer, the term of this patent is extended or adjusted under 35 U.S.C. 154(b) by 0 days.

(21) Appl. No.: 14/216,140

(22) Filed: Mar. 17, 2014

Related U.S. Application Data

(60) Provisional application No. 61/794,657, filed on Mar. 15, 2013.

(51) Int. Cl.
*E21B 33/038* (2006.01)
*E21B 33/06* (2006.01)
*E21B 33/035* (2006.01)

(52) U.S. Cl.
CPC ..... *E21B 33/035* (2013.01); *E21B 33/038* (2013.01)

(58) Field of Classification Search
CPC ..... E21B 33/038; E21B 33/06
USPC ..... 166/368, 351, 338, 339, 340, 341, 344,166/350
See application file for complete search history.

(56) References Cited

U.S. PATENT DOCUMENTS 3,653,435 A * 4/1972 Reistle, III ..... E21B 43/14 166/313
4,770,249 A * 9/1988 Courtney ..... E21B 33/04 166/379
4,911,244 A * 3/1990 Hynes ..... E21B 33/043 166/123
5,069,287 A * 12/1991 Short ..... E21B 33/035 166/339
5,135,266 A * 8/1992 Bridges ..... E21B 33/0422 285/123.12
6,015,009 A * 1/2000 Allen ..... E21B 33/0422 166/88.2
6,227,301 B1 * 5/2001 Edwards ..... E21B 33/035 166/344
6,997,260 B1 * 2/2006 Trader ..... E21B 29/10 138/99
7,520,322 B2 4/2009 Duhn et al.
7,726,393 B2 6/2010 Duhn et al.
7,779,921 B2 8/2010 Cain et al.
7,886,833 B2 * 2/2011 McGuire ..... E21B 33/047 166/348

(Continued)

FOREIGN PATENT DOCUMENTS

WO WO 2004111380 A2 * 12/2004

*Primary Examiner* — Matthew R Buck
*Assistant Examiner* — Edwin Toledo-Duran
(74) *Attorney, Agent, or Firm* — Greenberg Traurig LLP

(57) ABSTRACT

A wellhead system for supporting at least one section of a casing in a borehole for use with a conductor pipe and a method for installing a wellhead system upon a conductor pipe are disclosed. The wellhead system may include a wellhead housing having a central interior bore with a diameter that is smaller than the interior diameter of the conductor pipe and a blowout preventer having an interior bore having a diameter which is less than the diameter of the conductor pipe. The method may include securing a wellhead housing having a central interior bore with a diameter that is smaller than the interior diameter of the conductor pipe and associating with the wellhead housing a blowout preventer having a central interior bore with a diameter that is smaller than the interior diameter of the conductor pipe.

14 Claims, 4 Drawing Sheets

(56) References Cited

U.S. PATENT DOCUMENTS

| | | | | |
|---|---|---|---|---|
| 8,196,649 | B2 * | 6/2012 | Allen | E21B 33/03 166/375 |
| 2005/0051362 | A1 * | 3/2005 | McGuire | E21B 33/03 175/57 |
| 2005/0092496 | A1 * | 5/2005 | Duhn | E21B 33/068 166/308.2 |
| 2008/0223570 | A1 * | 9/2008 | Duhn | E21B 33/03 166/75.14 |
| 2009/0107685 | A1 * | 4/2009 | Cain | E21B 33/03 166/379 |
| 2011/0253378 | A1 * | 10/2011 | Willoughby | E21B 33/035 166/344 |

* cited by examiner

WELLHEAD SYSTEM AND METHOD FOR INSTALLING A WELLHEAD SYSTEM

RELATED APPLICATION

This Application claims the benefit, and priority benefit, of U.S. Patent Application Ser. No. 61/794,657, filed Mar. 15, 2013, entitled "Wellhead System and Method for Installing a Wellhead System".

BACKGROUND OF THE INVENTION

1. Field of the Disclosure

This disclosure relates generally to the field of drilling of wells for producing oil and/or gas.

2. Description of the Related Art

Oil and/or gas wells which are drilled for the production of oil and gas are typically begun by driving, or otherwise disposing or installing, a conductor pipe, or drive pipe, at the desired location where a borehole for the well is to be drilled. Typically, the conductor pipe is a large diameter conductor pipe, such as a 20 inch diameter conductor pipe.

Oil and/or gas wells typically include one or more pipe strings extending downwardly through the borehole into the Earth from its surface. The strings are disposed one within the other and serve various purposes, such as maintaining the structural integrity of the well and for controlling fluid flow and fluid pressures within the well. A pipe string, or "string" is typically referred to as a casing if there is at least one other string disposed within that string, and the innermost string is typically referred to as tubing. A wellhead system is provided for suspending the various strings of casing within the borehole. Initial drilling operations are generally conducted through a large diameter diverter assembly, as is known in the art, and the large diameter diverter assembly has the same diameter as the large diameter conductor, or drive, pipe.

BRIEF SUMMARY

The following presents a simplified summary of the disclosed subject matter in order to provide a basic understanding of some aspects of the subject matter disclosed herein. This summary is not an exhaustive overview of the technology disclosed herein. It is not intended to identify key or critical elements of the invention or to delineate the scope of the invention. Its sole purpose is to present some concepts in a simplified form as a prelude to the more detailed description that is discussed later.

In one illustrative embodiment, a method for installing upon a conductor pipe a wellhead system for supporting at least one section of a casing and a borehole, wherein the conductor pipe has an interior diameter and an upper end, may include: securing the wellhead housing to the upper end of the conductor pipe, the wellhead housing having upper and lower ends and a central interior bore extending between the upper and lower ends of the wellhead housing, the central interior bore of the wellhead housing having a diameter that is smaller than the interior diameter of the conductor pipe; and associating a blowout preventer, having upper and lower ends, with the upper end of the wellhead housing, the blowout preventer having a central interior bore extending between the upper and lower ends of the blowout preventer and a diameter which is less than the diameter of the conductor pipe.

In another illustrative embodiment, a wellhead system for supporting at least one section of a casing in a borehole, for use with a conductor pipe having an interior diameter and an upper end, may include: a wellhead housing having upper and lower ends and a central interior bore extending between the upper and lower ends of the wellhead housing, the central interior bore of the wellhead housing having a diameter that is smaller than the interior diameter of the conductor pipe; a blowout preventer, having upper and lower ends, and a central interior bore, extending between the upper and lower ends of the blowout preventer, having a diameter which is less than the diameter of the conductor pipe; and the central interior bore of the wellhead housing and the blowout preventer are in fluid communication with each other.

BRIEF DESCRIPTION OF THE DRAWING

The present wellhead system and method for installing a wellhead system may be understood by reference to the following description taken in conjunction with the accompanying drawing, in which.

Figure 1:
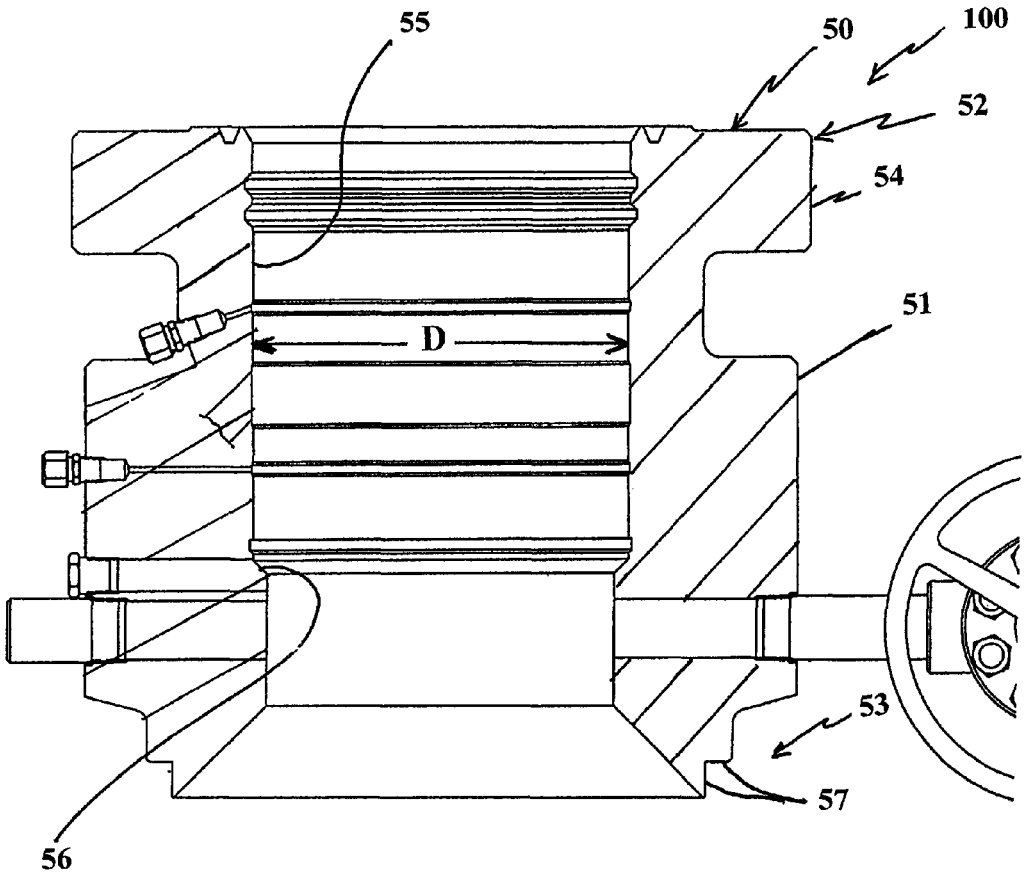
FIG. 1 is a partial cross-sectional view one embodiment of a wellhead housing of the present wellhead system.

While certain embodiments of the present method for installing a wellhead system and wellhead system will be described in connection with the preferred illustrative embodiments shown herein, it will be understood that it is not intended to limit the invention to those embodiments. On the contrary, it is intended to cover all alternatives, modifications, and equivalents, as may be included within the spirit and scope of the invention as defined by the appended claims. In the drawing figures, which are not to scale, the same reference numerals are used throughout the description and in the drawing figures for components and elements having the same structure, and primed reference numerals are used for components and elements having a similar function and construction to those components and elements having the same unprimed reference numerals.

DETAILED DESCRIPTION OF THE SPECIFIC EMBODIMENTS

With reference to FIG. 1, a wellhead housing 50 of an embodiment of the present wellhead system 100 is shown. Housing 50 includes a generally annular shaped housing body 51 having upper and lower ends 52, 53, and a central interior bore 55 extending between the upper and lower ends 52, 53 of the wellhead housing 51. The central interior bore 55 has an internal diameter D. The upper end 52 of housing 51 may be provided in a conventional manner with an annular flange member 54 which permits the upper end 52 of housing 51 to be secured to additional components of the wellhead system 100, as will hereinafter be described. Housing 51 may be made of any conventional materials suitable for use in equipment used for the drilling of oil and gas wells, as is known in the art. Housing 51 may include an interior landing shoulder 56 as is known in the art. The lower end 53 of housing 51 has an annular shoulder 57 on an outer wall surface of housing 51, which is adapted to be welded to the upper end of a conductor pipe, as will hereinafter be described.

Figure 2:
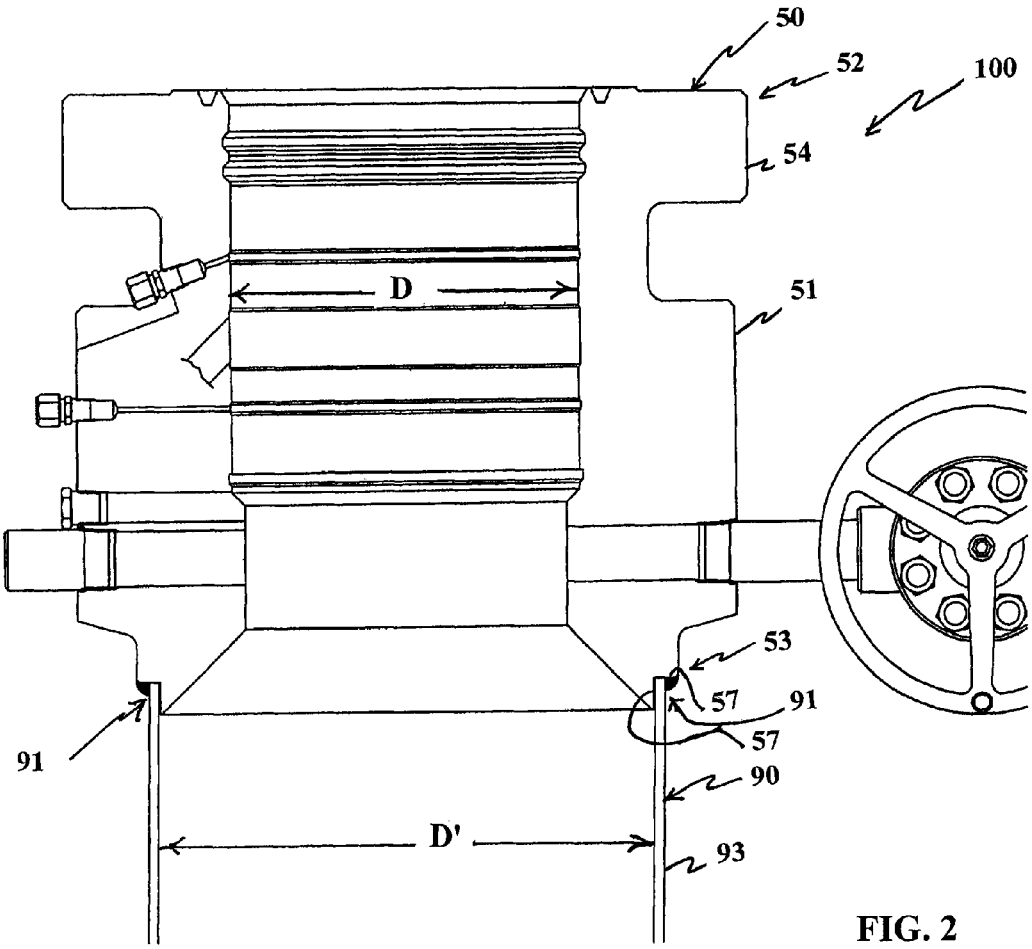
FIG. 2 is a partial cross-sectional view of the wellhead housing of FIG. 1 secured to the upper end of a conductor pipe.
Figure 3:
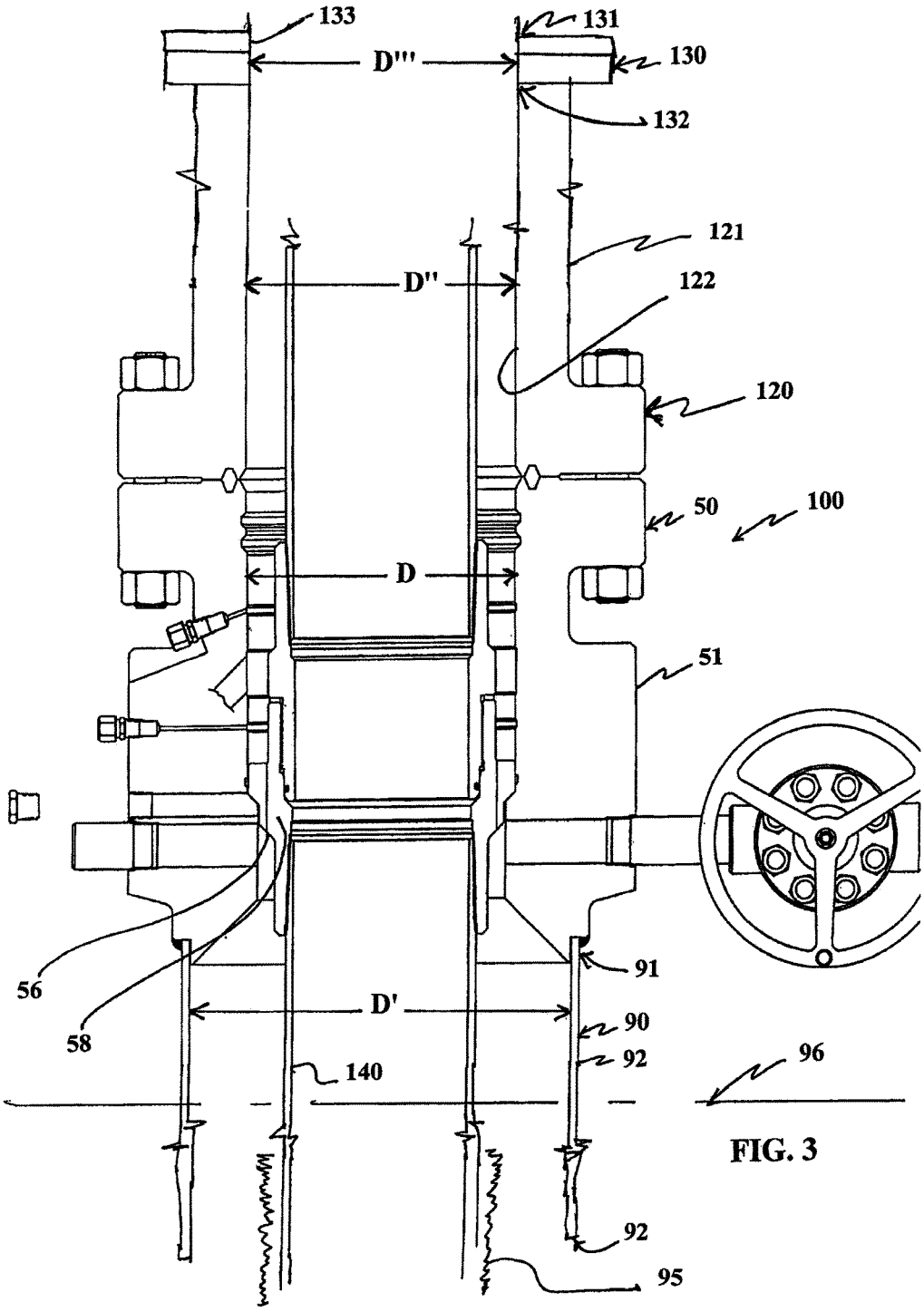
FIG. 3 is a partial cross-sectional view of the wellhead housing and conductor pipe of FIG. 2, including a blowout preventer stack and a blowout preventer with at least one section of a casing suspended within the wellhead housing.

With reference to FIG. 2, wellhead housing 51 of wellhead system 100 is installed upon a conductor pipe 90. Conductor pipe 90 has an upper end 91 and a lower end 92 (FIG. 3) extends into the Earth's surface at a location at which it is desired to drill a borehole 95 (FIG. 3). The wellhead housing 151 may be lowered upon the upper end 91 of conductor pipe 90 in a conventional manner prior to welding housing 151 to conductor pipe 90. Conductor pipe 90 is conventional in the art of drilling oil and gas wells, and is typically a large diameter pipe, such as an annular conductor pipe 93 having an interior diameter D'. The lower end 53 of wellhead housing 51 is secured to the upper end 91 of conductor pipe 90, as by welding annular shoulder 57 to the upper end 91 of conductor pipe 90. Typically, in the drilling of oil and gas wells, a conductor pipe 90 will be driven into the Earth's surface 96 (FIG. 3) at a location where it is desired to drill borehole 95 (FIG. 3). As seen in FIG. 2, the interior diameter D of wellhead housing 51 is smaller than the interior diameter D' of conductor pipe 90. As an illustrative embodiment, and to illustrate the relationship between the central interior bore 55 of wellhead housing 51 and the interior diameter D' of conductor pipe 90, conductor pipe 90 is typically referred to as a 20 inch conductor pipe, and has an interior diameter D' of approximately 20 inches. The diameter D of the central interior bore of wellhead housing 51 is approximately 13⅝ inches, and wellhead housing 51 is typically referred to as a "13⅝ inch wellhead housing".

With reference to FIG. 3, after wellhead housing 51 has been secured to the upper end 91 of conductor pipe 93, as shown in FIG. 2, a blowout preventer stack 120 is secured to the upper end 52 of wellhead housing 51. Blowout preventer stack, or BOP stack, 120 includes, in a conventional manner, a blowout preventer ("BOP") 130 which is shown schematically and may be of conventional construction. The BOP stack includes a BOP stack housing 121 having a central interior bore 122 having an interior diameter D" which is substantially the same as the interior diameter D' of wellhead housing 51. Blowout preventer 130 may be of conventional design and includes upper and lower ends 131, 132 and is associated with the upper end 52 of wellhead housing 51 via the BOP stack housing 121 in a conventional manner. BOP 130 has a central interior bore extending between the upper and lower ends 131, 132 of BOP 130, and the central interior bore 133 of blowout preventer 130 has a diameter D'" that is also smaller than the interior diameter of D' of conductor pipe 90. Again, for illustrative purposes in connection with FIG. 3, the interior diameter D'" of blowout preventer 130 is approximately 13⅝ inches and is substantially the same size as the diameter D of wellhead housing 51. Interior diameter D'" of BOP 130 is substantially less than the interior diameter D' of conductor pipe 90. Blowout preventer 130 may be of conventional construction and is typically referred to a 13⅝ inch bore BOP.

Figure 4:
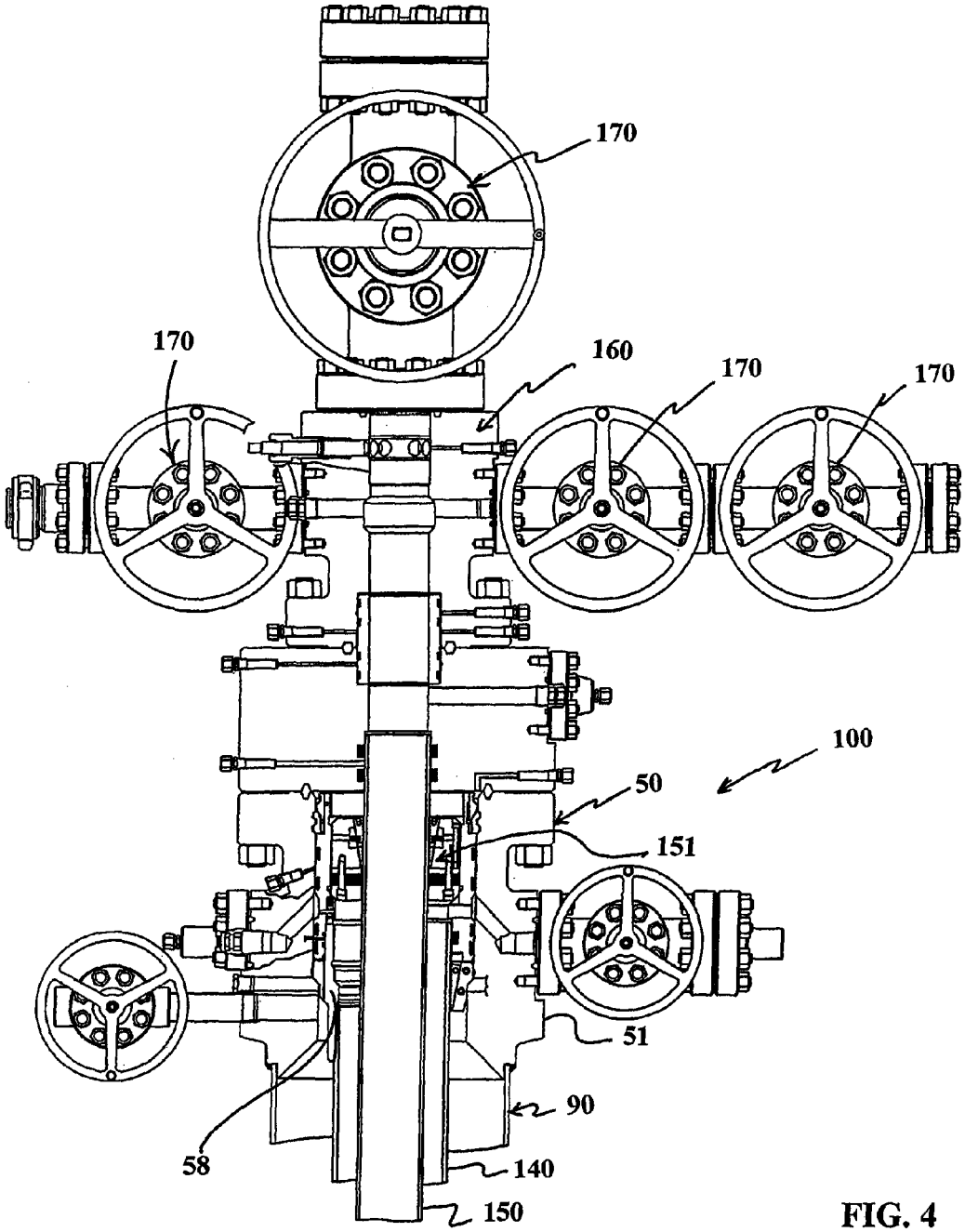
FIG. 4 is a partial cross-sectional view of the wellhead housing of FIGS. 1-3, including other components of a wellhead system.

Still with reference to FIG. 3, after the BOP stack 120 and blowout preventer 130 have been associated with wellhead housing 51, drilling operations may be started to drill borehole 95, and the drilling operations are conducted through the central interior bores 133 of the blowout preventer 130, central interior bore 55 of wellhead housing 51, as well as through the central interior bore 122 of the BOP stack housing 121. Thereafter, a section of casing 140 may be suspended from wellhead housing 51 into borehole 95, as by use of a casing hanger 58 which may be landed in a conventional manner upon landing shoulder 56 of wellhead housing 51. By way of example and for illustrative purposes, the section of casing 140 can be a section of 9⅝ inch casing. Thereafter, other conventional well drilling operations could be conducted, including cementing of casing 140, as well as drilling additional lengths of borehole 95 and suspending another section of casing 150 within casing 140 as shown in FIG. 4. These subsequent operations may also be conducted through the BOP 130 of FIG. 3.

As seen in FIG. 4, additional components may be added to the present wellhead system 100, after completion of drilling operations, such as casing hanger 151 for casing 150, a conventional tubing head 160, and a plurality of gate valves 170.

It should be noted that all of the foregoing described drilling operations may be conducted through the bore 133 of the BOP 130 and through the straight, substantially same size interior bore 55 of the wellhead housing 51. Such "thru-bore" operations may be accomplished because the present wellhead system 100 is a "thru-bore" system which can utilize a BOP 130 that is typically already present on a drilling rig, and does not require the use of a large diameter diverter assembly as used in the prior art.

Specific embodiments of the present wellhead system and method for installing a wellhead system have been described and illustrated. It will be understood to those skilled in the art that changes and modifications may be made without departing from the spirit and scope of the inventions defined by the appended claims.

I claim:

1. A method for installing upon a conductor pipe, having an interior diameter, a conductor pipe upper end, and a conductor pipe lower end extending into a ground surface, a wellhead system for supporting at least one section of a casing in a borehole to be drilled onshore into the ground surface, comprising:

lowering a wellhead housing on top of the conductor pipe upper end and welding the wellhead housing to the conductor pipe upper end, the wellhead housing having a wellhead housing upper end, a wellhead housing lower end, a wellhead housing central interior bore extending between the wellhead housing upper end and the wellhead housing lower end, and the wellhead housing upper end having an annular flange member, the wellhead housing central interior bore having a diameter that is smaller than the interior diameter of the conductor pipe;

securing a blowout preventer, having a blowout preventer upper end and a blowout preventer lower end, to the annular flange member of the wellhead housing upper end; the blowout preventer having a blowout preventer central interior bore extending between the blowout preventer upper end and the blowout preventer lower end, and the blowout preventer central interior bore having a diameter which is less than the interior diameter of the conductor pipe;

drilling a first borehole, adjacent to and in a spaced relationship from, the conductor pipe, after the wellhead housing has been welded to the conductor pipe and conducting the drilling through the blowout preventer central interior bore and the wellhead housing central interior bore;

suspending a first section of casing from the wellhead housing into the first borehole;

drilling a second borehole adjacent to, and in a spaced relationship from, the first section of casing; and suspending a second section of casing from the wellhead housing into the second borehole.

2. The method of claim 1, wherein the diameter of the wellhead housing central interior bore and the diameter of the blowout preventer central interior bore are substantially the same; and the diameter of the blowout preventer central interior bore is substantially less than the interior diameter of the conductor pipe.

3. The method of claim 1, including utilizing as the wellhead housing, a wellhead housing having an annular shoulder on an outer wall surface of the wellhead housing lower end, the outer wall surface being at the wellhead housing lower end, and securing the wellhead housing to the conductor pipe upper end by welding the annular shoulder of the wellhead housing to the conductor pipe upper end.

4. A wellhead system for supporting at least one section of a casing in an onshore borehole, for use with a conductor pipe having an interior diameter and a conductor pipe upper end, comprising:

a wellhead housing having a wellhead housing upper end, a wellhead housing lower end, and a wellhead housing central interior bore extending between the wellhead housing upper end and the wellhead housing lower end, the wellhead housing upper end having an annular flange member, the wellhead housing central interior bore having a diameter that is smaller than the interior diameter of the conductor pipe, and the wellhead housing has an annular shoulder on an outer wall surface of the wellhead housing lower end, the outer wall surface being at the wellhead housing lower end, and the annular shoulder is adapted to be welded on top of the conductor pipe upper end;

a blowout preventer, having a blowout preventer upper end, a blowout preventer lower end, and a blowout preventer central interior bore, extending between the blowout preventer upper end and the blowout preventer lower end, the blowout preventer central interior bore having a diameter which is less than the interior diameter of the conductor pipe, the blowout preventer lower end being associated with the annular flange member of the wellhead housing upper end; and the wellhead housing central interior bore and the blowout preventer central interior bore are in fluid communication.

5. The wellhead system of claim 4, wherein the diameter of the wellhead central interior bore and the diameter of the blowout preventer central interior bore are substantially the same.

6. The wellhead system of claim 4, wherein the diameter of the blowout preventer central interior bore is substantially less than the interior diameter of the conductor pipe.

7. The wellhead system of claim 4, including a section of casing suspended from the wellhead housing.

8. A method for installing upon a conductor pipe, having an interior diameter, a conductor pipe upper end, and a conductor pipe lower end extending into a ground surface, a wellhead system for supporting at least one section of a casing in a borehole drilled into the ground surface, comprising:

lowering a 13⅝ inch wellhead housing on top of the conductor pipe upper end and welding the wellhead housing to the conductor pipe upper end, the wellhead housing having a wellhead housing upper end, a wellhead housing lower end, a wellhead housing central interior bore extending between the wellhead housing upper end and the wellhead housing lower end, and the wellhead housing upper end having an annular flange member, the wellhead housing central interior bore having a diameter that is smaller than the interior diameter of the conductor pipe;

securing a 13⅝ inch bore blowout preventer, having a blowout preventer upper end and a blowout preventer lower end, to the annular flange member of the wellhead housing upper end;

the blowout preventer having a blowout preventer central interior bore extending between the blowout preventer upper end and the blowout preventer lower end, and the blowout preventer central interior bore having a diameter which is less than the interior diameter of the conductor pipe;

drilling a first borehole, within and adjacent to and in a spaced relationship from, the conductor pipe, after the wellhead housing has been welded to the conductor pipe and conducting the drilling through the blowout preventer central interior bore and the wellhead housing central interior bore;

suspending at least one first section of casing from the wellhead housing into the first borehole;

drilling a second borehole within and, adjacent to, and in a spaced relationship from, the first section of casing; and suspending at least one second section of casing from the wellhead housing into the second borehole.

9. The method of claim 8, wherein the diameter of the wellhead housing central interior bore and the diameter of the blowout preventer central interior bore are substantially the same; and the diameter of the blowout preventer central interior bore is substantially less than the interior diameter of the conductor pipe.

10. The method of claim 8, including utilizing as the wellhead housing, a wellhead housing having an annular shoulder on an outer wall surface of the wellhead housing lower end, the outer wall surface being at the wellhead housing lower end, and securing the wellhead housing to the conductor pipe upper end by welding the annular shoulder of the wellhead housing to the conductor pipe upper end.

11. An onshore wellhead system for supporting at least one section of a casing in an onshore borehole, for use with an onshore conductor pipe having an interior diameter and a conductor pipe upper end, comprising:

a 13⅝ inch wellhead housing having a wellhead housing upper end, a wellhead housing lower end, and a wellhead housing central interior bore extending between the wellhead housing upper end and the wellhead housing lower end, the wellhead housing upper end having an annular flange member, the wellhead housing central interior bore having a diameter that is smaller than the interior diameter of the conductor pipe, and the wellhead housing has an annular shoulder on an outer wall surface of the wellhead housing lower end, the outer wall surface being at the wellhead housing lower end, and the annular shoulder is adapted to be welded on top of the conductor pipe upper end;

a 13⅝ inch bore blowout preventer, having a blowout preventer upper end, a blowout preventer lower end, and a blowout preventer central interior bore, extending between the blowout preventer upper end and the blowout preventer lower end, the blowout preventer central interior bore having a diameter which is less than the interior diameter of the conductor pipe, the blowout preventer lower end being secured to the annular flange member of the wellhead housing upper end; and the wellhead housing central interior bore and the blowout preventer central interior bore are in fluid communication.

12. The wellhead system of claim 11, wherein the diameter of the wellhead central interior bore and the diameter of the blowout preventer central interior bore are substantially the same.

13. The wellhead system of claim 11, wherein the diameter of the blowout preventer central interior bore is substantially less than the interior diameter of the conductor pipe.

14. The wellhead system of claim 11, including a section of casing suspended from the wellhead housing.

* * * * *